US005249024A

United States Patent [19]

Menjo

[11] Patent Number: 5,249,024

[45] Date of Patent: Sep. 28, 1993

[54] IMAGE FORMING APPARATUS INCLUDING FIXING MEANS WITH VARIABLE FIXING SPEED

[75] Inventor: Takeshi Menjo, Tokyo, Japan

[73] Assignee: Canon Kabushiki Kiasha, Tokyo, Japan

[21] Appl. No.: 724,773

[22] Filed: Jul. 2, 1991

[30] Foreign Application Priority Data

Jul. 5, 1990 [JP] Japan ..... 2-178344

[51] Int. Cl.[5] ..... G03G 15/20

[52] U.S. Cl. ..... 355/282; 355/271; 355/274

[58] Field of Search ..... 355/282, 285, 289, 290, 355/295, 311, 321; 219/216, 388, 469; 432/60, 228; 34/25, 52

[56] References Cited

U.S. PATENT DOCUMENTS 4,719,489 1/1988 Ohkubo et al. ..... 355/290
4,899,196 2/1990 Mahoney ..... 355/271
4,912,515 3/1990 Amemiya et al. ..... 355/274
4,914,737 4/1990 Amemiya et al. ..... 355/276
5,075,732 12/1991 Menjo ..... 355/282

*Primary Examiner*—Leo P. Picard
*Assistant Examiner*—Christopher Horgan
*Attorney, Agent, or Firm*—Fitzpatrick, Cella, Harper & Scinto

[57] ABSTRACT

An image forming apparatus includes a recording material carrying unit for carrying and conveying a recording material. The recording material carrying unit can simultaneously carry a first sheet of recording material and a second sheet of recording material at different positions thereon. The apparatus also includes an image forming unit for forming an image on the recording material carried on the recording material carrying unit, and a fixing unit with a variable fixing speed for fixing the image on the recording material separated from the recording material carrying unit. An interval between the entering times of the first sheet of recording material and the second sheet of recording material carried on the recording material carrying unit is variable in accordance with the fixing speed.

16 Claims, 6 Drawing Sheets

IMAGE FORMING APPARATUS INCLUDING FIXING MEANS WITH VARIABLE FIXING SPEED

BACKGROUND OF THE INVENTION

1. Field of the Invention

This invention relates in general to an electrophotographic or elestrostatic-recording image forming apparatus for forming an image on a recording material and subsequently fixing the image on the recording material by a fixing means. In particular, the present invention may be suitably applied to a color electrophotographic apparatus or the like.

2. Description of the Related Art

In a conventional image forming apparatus, such as a color electrophotographic apparatus or the like, a technique is known wherein toner images of a plurality of colors formed on a photosensitive drum, serving as an image bearing member, are individually transferred onto a recording material, such as paper or the like, and carried on a transfer drum, serving as a recording material carrying means, with superposing respective images. After the image transfer, the recording material is separated from the transfer drum, and is conveyed to a fixing device by a conveying belt.

The superposed toner images of the plurality of colors formed on the recording material are fused by means of heat and pressure in the fixing device comprising a fixing roller and a pressing roller to provide a full-color image, and the image is fixed on the recording material.

The above-described image forming apparatus, however, has the following problems.

That is, normal paper has generally been used as the recording material. Particularly, paper having a weight of about 50–90 g/m$^2$ has been mostly used. However, in accordance with recent various needs, more kinds of recording materials have been desired. In some cases, thick paper having, for example, a weight of 90–150 g/m$^2$, a recording material made of a resin-like film, or the like, has been used. Particularly, the resin-like recording material has been used in most cases as a transparent OHP (overhead projector) film. When using such recording materials, in fixing an image, it is necessary to perform a fixing operation at a speed lower than in conventional cases.

For example, in the present case, if the process speed of the main body is assumed to be 84 mm/sec, the fixing speed (the recording material conveying speed in the fixing device) is usually 84 mm/sec when normal paper is used as the recording material.

However, when a fixing operation is performed for thick paper used as the recording material, the above-described fixing speed is insufficient. Since the heat capacity for fusing toner particles is insufficient, the gloss of the image disappears after the fixing operation, or so-called "cold offset", wherein toner particles do not adhere to the recording material, occurs. Cold offset apts to occur particularly in a color image forming apparatus. Cold offset occurs because toner particles adhere onto the recording material and form thick multiple layers, i.e., 2–4 layers, and the heat from the fixing roller side is not effectively transmitted to the lowermost layer. Therefore, the toner particles in the lowest layer are not effectively fused. Furthermore, since the heat from the back surface of thick paper does not effectively reach toner particles in the lowermost layer, toner particles in the lowermost layer are not effectively fused. As a result, the anchoring effect of the toner for the paper cannot be obtained, and so the toner peels from the paper. Accordingly, when performing a fixing operation using thick paper as the recording material, it is necessary to perform the fixing operation at a speed lower than when performing a fixing operation using normal paper as the recording material. The fixing speed in such a case is set to 25 mm/sec.

When using a resin-like film as the recording material, since heat is not effectively transmitted as in the case of thick paper, and the surface of the film is very smooth, the anchoring effect of the toner cannot be obtained, and so the toner peels off. Hence, it is necessary to perform a fixing operation at a low speed (25 mm/sec) as in the case of thick paper.

When using an OHP film as the recording material, in order to obtain a color-forming property and a light-transmitting property of an image, and to provide excellent colors of color toners when projecting the image, it is necessary to fix toner particles at a low speed (a fixing speed of 25 mm/sec) in order to fuse the toner particles, mix colors of the toner particles, and sufficiently fix the toner particles.

In the above-described image forming apparatus, a technique has been known wherein a plurality of sheets of the recording material are simultaneously carried at different positions on the transfer drum in order to increase the copying speed. For example, a case will be considered wherein the process speed is 84 mm/sec (the recording-material conveying speed of the transfer drum is also 84 mm/sec) as described above. A transfer operation is performed while carrying two sheets of the recording material on the transfer drum, the two sheets are separated from the transfer drum, and the two sheets of the recording material conveyed by the conveying belt successively pass through the fixing device. When the fixing device performs a fixing operation at a low speed (25 mm/sec), the second sheet of the recording material overtakes the first sheet being fixed. As a result, images on the first and second sheets of the recording material may be disturbed, or jamming of the sheets may occur.

SUMMARY OF THE INVENTION

The present invention has been made in consideration of the above-described problems.

It is an object of the present invention to provide an image forming apparatus which can prevent the occurrence of disturbance of an image on a recording material, jamming of the recording material, and which can always obtain an image having a stable picture quality.

It is another object of the present invention to provide an image forming apparatus which has excellent fixability of an image on a recording material irrespective of the kind of recording material used.

In accordance with one aspect of the invention, an image forming apparatus comprises recording material carrying means for carrying and conveying a recording material, with the carrying means being capable of simultaneously carrying first and second sheets of the recording material at different positions thereon. Image forming means forms an image on the recording material carrying means, and separating means separates the recording material from the recording material carrying means after an image is formed. Fixing means fixes the image on the recording material after it is separated from the recording material carrying means, with the fixing means having a variable fixing speed. In addition, conveying means is provided to convey the recording material separated from the recording material carrying means to the fixing means. The interval between a first entering time when the fixing means receives the first sheet and a second entering time when the fixing means receives the second sheet is varied based on the fixing speed of the fixing means.

These and other objects and aspects of the present invention will become more apparent from the following detailed description of the preferred embodiments taken in connection with the accompanying drawings.

DETAILED DESCRIPTION OF THE PREFERRED EMBODIMENTS

An image forming apparatus according to the present invention will now be explained in detail with reference to the drawings.

Figure 1:
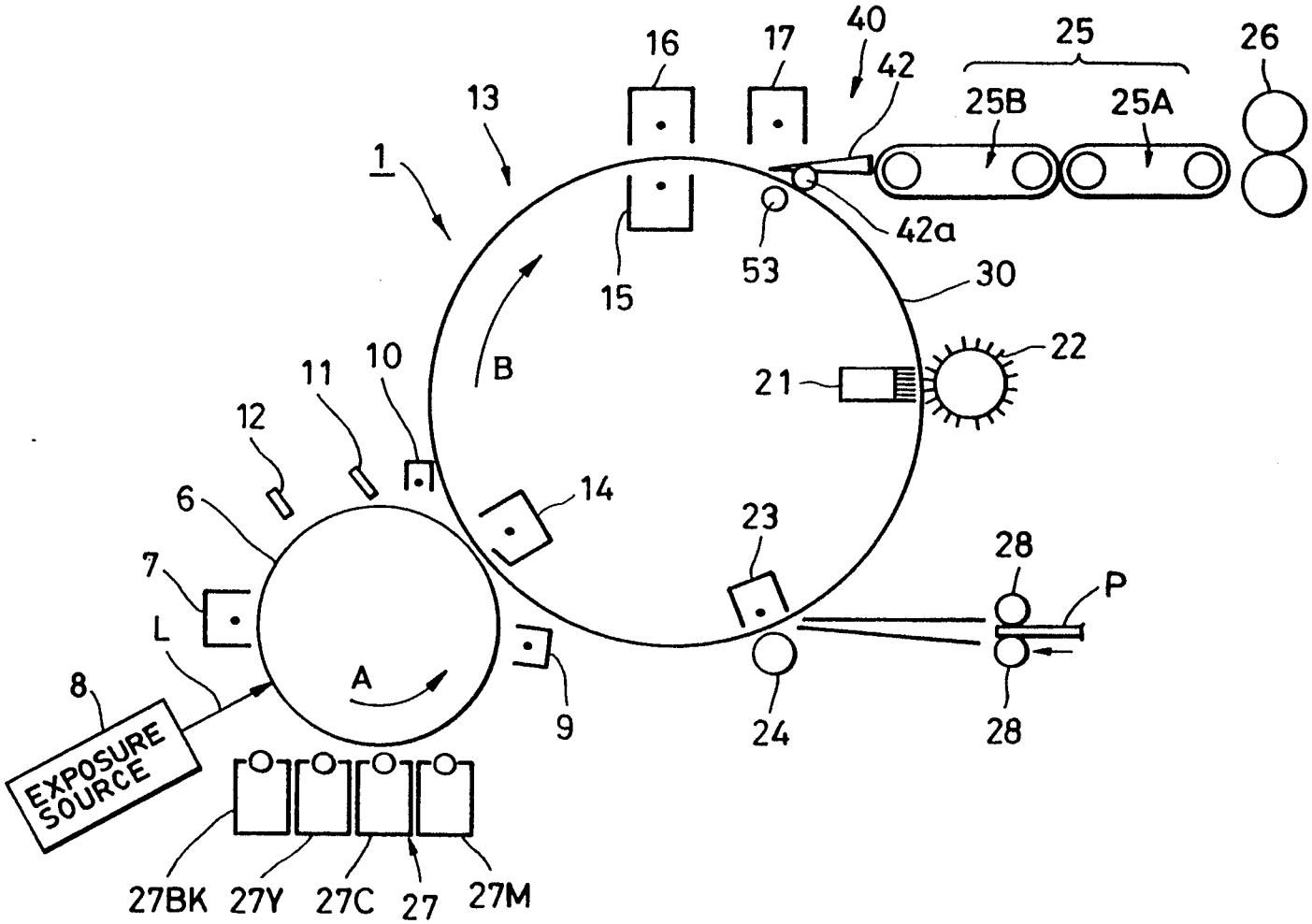
FIG. 1 is a schematic diagram of an image forming apparatus according to an embodiment of the present invention.

FIG. 1 shows an image forming apparatus according to an embodiment of the present invention.

In a color electrophotographic copying apparatus 1 of the present embodiment, a photosensitive drum 6, serving as an image bearing member, is rotatably pivoted so as to be rotated in the direction of Arrow A. Image forming process means for the photosensitive drum 6 are disposed around the photosensitive drum 6. The moving speed (process speed) of the photosensitive drum 6 is 84 mm/sec. That is, the photosensitive drum 6 is uniformly charged by a primary charger 7, and a light image L subjected to color separation by an exposure means 8 comprising, for example, a laser-beam exposure device or the like, or a light image corresponding to such a light image is projected onto the photosensitive drum 6 to form an electrostatic latent image on the photosensitive drum 6. The electrostatic latent image on the photosensitive drum 6 is made to be a visible image, that is, a toner image, by a moving developing device 27.

Figure 2:
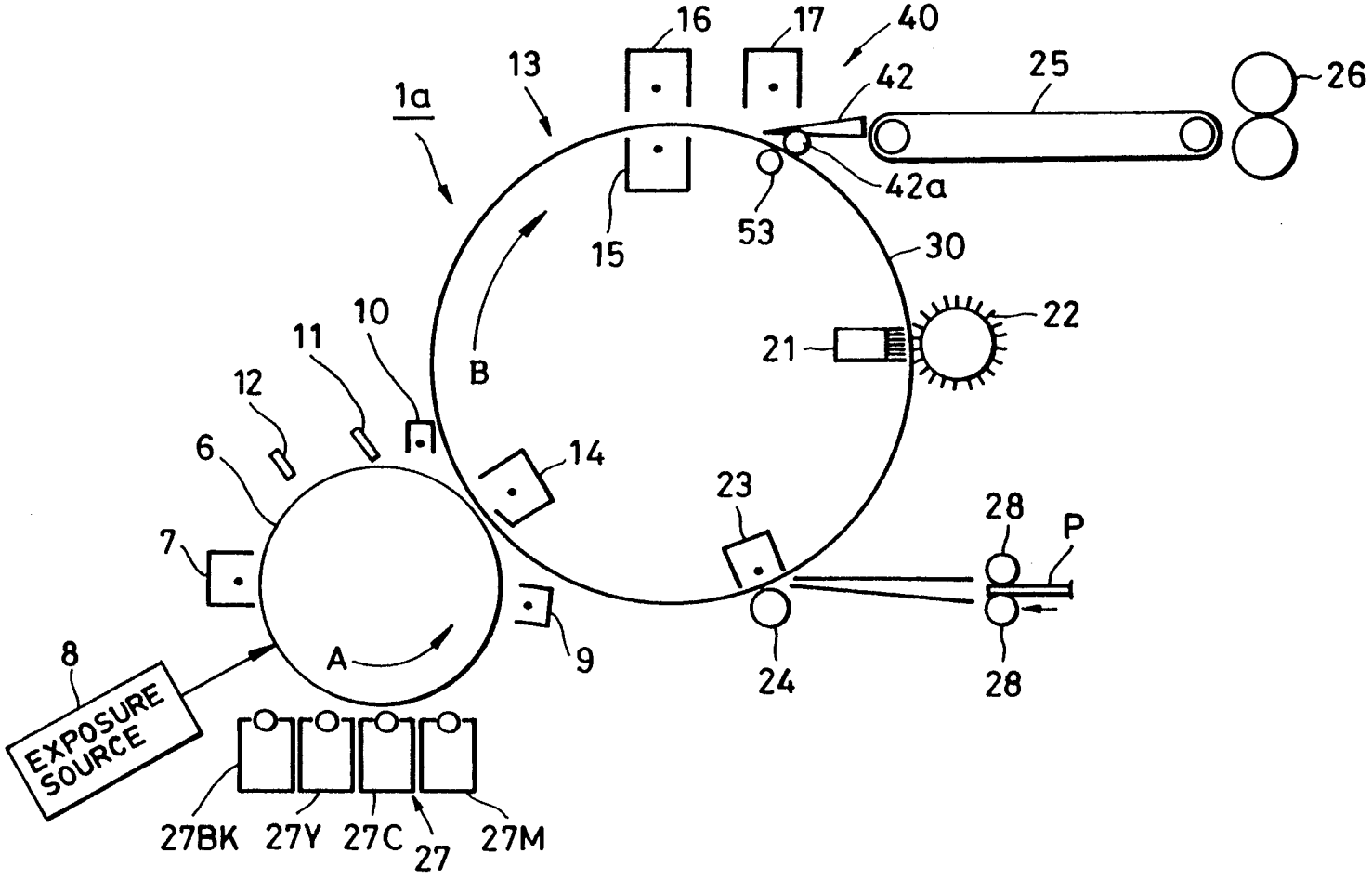
FIG. 2 is a schematic diagram of an image forming apparatus according to a second embodiment of the present invention.

Exposure source 8 shown in block outline in FIGS. 1 and 2 is well known per se and a specific type or construction is not critical to carrying out the invention or for disclosure of the best mode for carrying out the invention.

The moving developing device 27 comprises four developing units 27M, 27C, 27Y and 27BK receiving four-color developers, i.e., magenta-color developer, cyan-color developer, yellow-color developer and black-color developer, respectively, and a moving platform (not shown) capable of holding these four developing units and moving them in the horizontal direction. The moving developing device 27 conveys a desired developing unit to a position facing the outer circumferential surface of the photosensitive drum 6, and develops the electrostatic latent image on the photosensitive drum 6.

The toner image on the photosensitive drum 6 is transferred to a transfer material P conveyed in the direction of Arrow B and is carried by a transfer/separation device 13.

Figure 3:
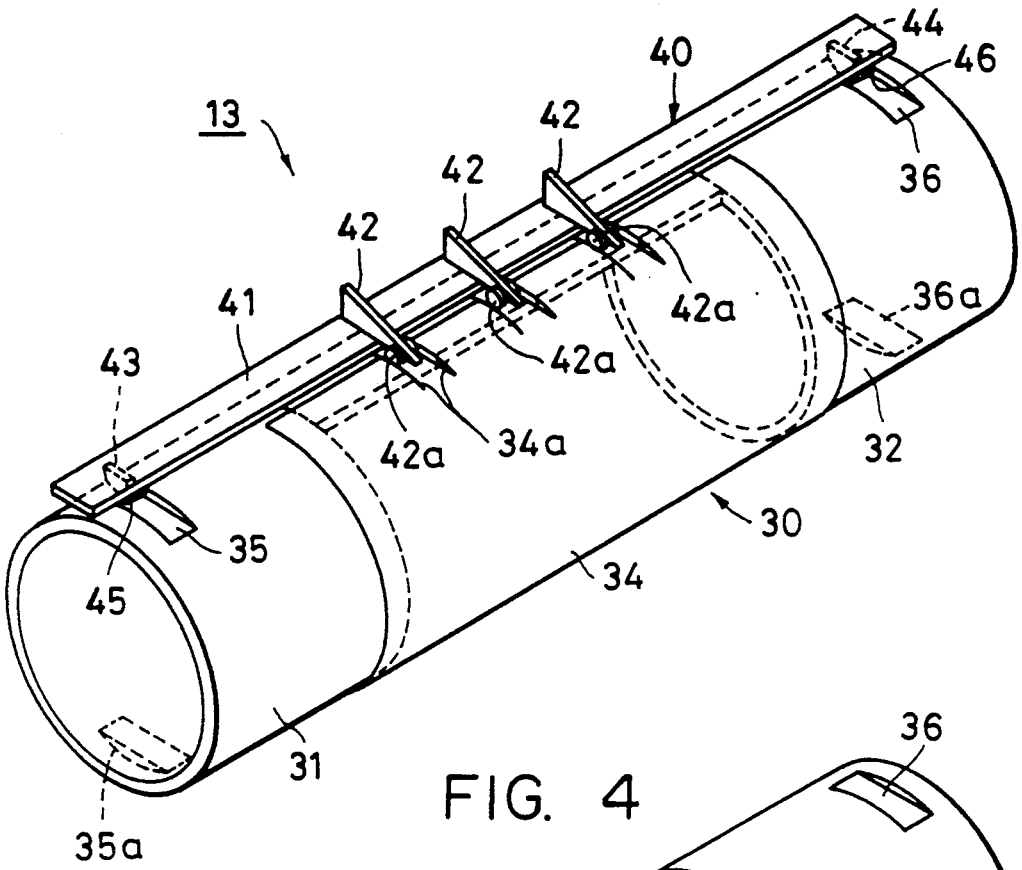
FIG. 3 is a perspective view of a transfer/separation device.
Figure 4:
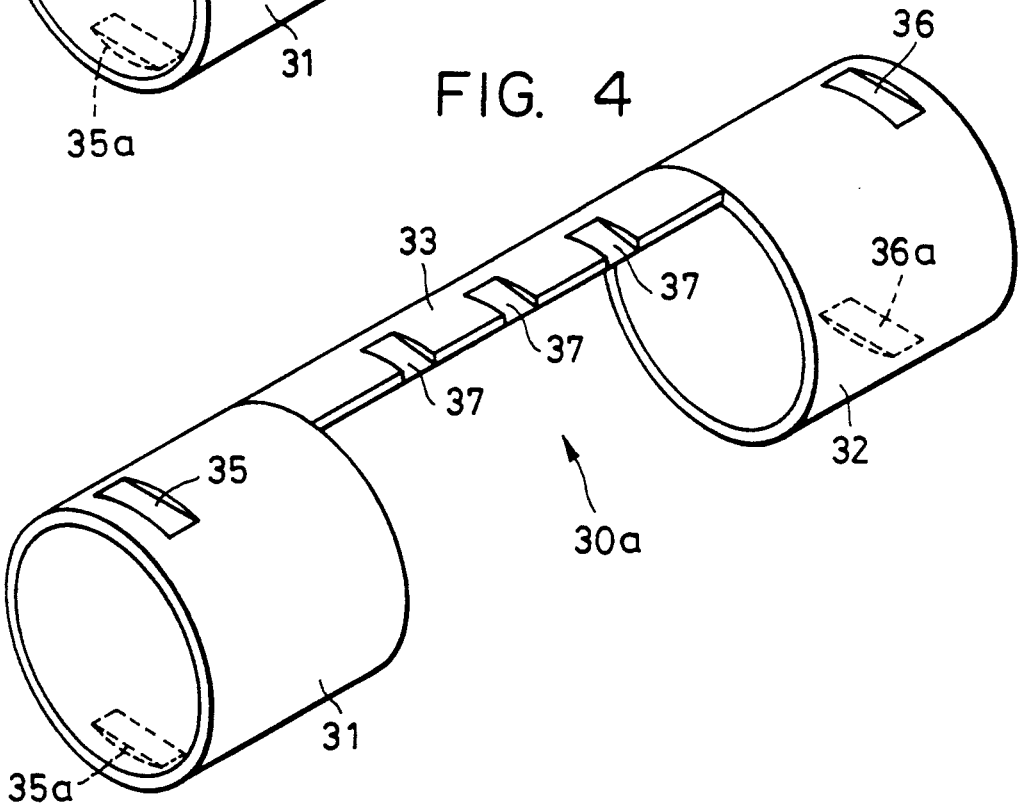
FIG. 4 is a perspective view of the frame of a transfer drum.
Figure 6:
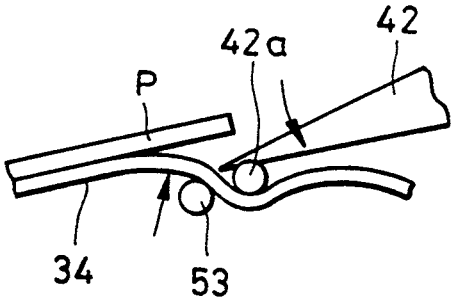
FIG. 6 is a diagram illustrating the operation of separating a transfer material.

An explanation will now be provided of the transfer/separation device 13 with reference to FIGS. 3 and 6.

A transfer drum 30, which is part of the transfer/separation device 13 and serves as a recording material carrying means for carrying a recording material, comprises a drum frame 30*a* comprising columnar rings 31 and 32 disposed at its both ends and a connecting unit 33 for connecting the columnar rings 31 and 32, and a dielectric transfer sheet 34 made of PVdF (polyvinylidene fluoride resin) wound around the drum frame 30*a*. It is desirable that the volume resistivity of the transfer sheet 34 is $10^8$–$10^{16}$ Ω·cm. The diameter of the transfer drum 30 is, for example, 160 mm, and the circumference of the transfer drum 30 is at least twice the shorter side of the A4 format.

A separation means 40, which is part of the transfer/separation device 13, comprises a separation pawl supporting member 41 provided in the direction of the axis of the transfer drum 30, and a plurality of (three in the present embodiment) separation pawls 42 fixed on the supporting member 41. A pressing roller 42*a* for separation is provided as one body at a front-end portion of each separation pawl 42. butting rollers 45 and 46 are provided at both end portions of the supporting member 41 via appropriate supporting plates 43 and 44. When a separation-pawl operation clutch (not shown) operates, the butting rolls 45 and 46 contact the columnar rings 31 and 32 of the transfer drum 30, and are guided by guide grooves 35 and 36 formed in the rings 31 and 32, respectively, to rotate the front ends of the separation pawls 42 downwardly, that is, in the direction normal to the transfer drum 30.

Figure 5:
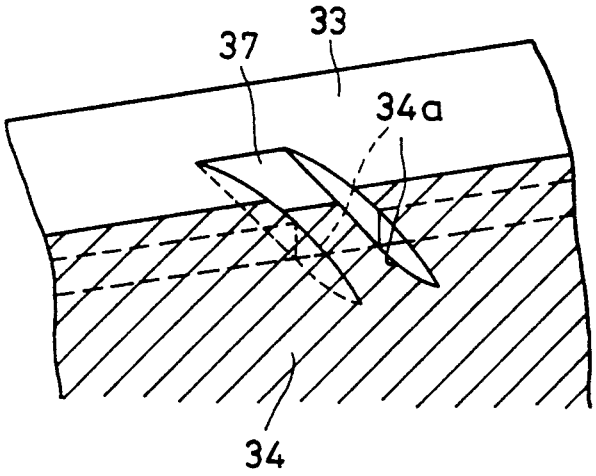
FIG. 5 is a perspective view illustrating a connecting portion of a transfer sheet to a connecting unit.

Notches 37 are formed on the connecting unit 33 so that the separation pawls 42 easily enter between the transfer sheet 34 and the transfer material P adhered to the transfer sheet 34. Slits 34*a* are provided at front-end portions of the transfer sheet 34 along the notches 37 of the connecting unit 33 until the area of the recording material where no toner image is present. The transfer sheet 34 is fixed to the connecting unit 33 so that the curvature of the transfer sheet 34 (the hatched portion in FIG. 5) is increased at that portion.

As shown in FIG. 1, a recording material P is fed by registration rollers 28 is synchronization with the image on the photosensitive drum 6. The transfer/separation device 13 comprises a recording material adhering means for adhering and holding the recording material P fed to the transfer drum 30 on the transfer sheet 34. The recording material adhering means comprises a corona charger 23 for adhering which is provided within the transfer drum 30 and provides the back surface of the transfer sheet 34 with electric charges having an opposite polarity to that of the toner image on the photosensitive drum 6, and a conductive roller 24 provided outside the transfer drum 30. The conductive roller 24 is grounded, serves as an electrode facing the corona charger 23 for adhesion, and has the function of injecting electric charges into the transfer sheet 34 and electrostatically adhering the recording material P on the transfer sheet 34. In an adhesion operation, the conductive roller 24 is disposed so as to form a gap of 0–100 μm with the transfer sheet 34. Preferably, the recording material P is supplied so that the front end of the recording material P overlaps the slits 34*a* of the transfer sheet 34 and does not enter the toner-image region.

When a continuous copying operation for a plurality of sheets of recording material is asigned from an operation panel (not shown), if the length of the recording material in the direction of feeding is less than half the length obtained by subtracting the width of the connecting unit 33 from the circumference of the tranfer drum 30, a second sheet of recording material is fed in succession to the first sheet, and the second sheet is electrostatically adhered on the transfer sheet 34 at a position symmetrical with the first sheet. That is, the two sheets of the recording material are fed while being simultaneously adhered at different positions on the transfer sheet 34. It is thereby possible to obtain a copying speed which is about twice the copying speed when performing a copying operation while adhering only one sheet of the recording material on the transfer sheet 34.

In order to transfer a developer having a first color, for example, a magenta toner, on the photosensitive drum 6 to the first sheet of recording material, electric charges having an opposite polarity to the polarity of the toner are transferred to the back surface of the transfer sheet 34 by a corona charger 14. Subsequently, the same latent image is formed again on the photosensitive drum 6, the image is formed again on the photosensitive drum 6, the image is developed by the toner having the first color, and the toner is transferred to the second sheet of recording material in the same manner. Before the first sheet of the recording material reaches the position of the conductive roller 24, the conductive roller 24 is released and separated to a position not disturbing the transferred toner image, for example, at least 2 mm from the transfer sheet 34. A toner image of a second color (a cyan color in this case) on the photosensitive drum 6 formed in synchronization with the first sheet of recording material to which the toner of the first color has been tranferred is transferred to the first sheet after it is again charged by the corona charger 14.

In the same manner, the toner image of the second color is transferred to the second sheet of recording material. Subsequently, in the same manner, toners of four colors are transferred to the first and second sheets of recording material. In such a way, toner images are formed on the recording material using the photosensitive drum 6, the primary charger 7, the exposure means 8 and the corona charger 14, which comprise an image forming means. After the completion of the tranfer process, in order to reduce the adsorbing force of the recording material on the transfer sheet 34, electric charges are removed from the transfer sheet 34 by using a pair of oppositely facing AC corona chargers 15 and 16.

The first sheet of recording material is separated from the transfer sheet 34 by pressing the pressing rollers 42*a* for outward separation against the transfer sheet 34. As shown in FIG. 3, the pressing rollers 42*a* are formed as one body with the separation pawls 42 guided by the grooves 35 and 36 on the rings 31 and 32 to follow the separation pawls 42 against the transfer sheet 34. The pressing rollers 42*a* for outward separation move along the notchs 37 of the connecting unit 33. The separation pawls 42 enter between the front end of the first sheet of the recording material and the transfer sheet 34, at a portion where the curvature of the transfer sheet 34 is reduced, to separate the recording material from the tranfer sheet 34. When separating the second sheet of recording material from the transfer sheet 34, as shown in FIG. 6, pressing rollers 53 for inward separation which follow the transfer sheet 34 are pressed against the transfer sheet 34. In addition, the pressing rollers 42*a* for outward separation are also pressed against the transfer sheet 34 while being guided by grooves 35*a* and 36*a* provided on the opposite side of the connecting unit 33 on the rings 31 and 32, respectively, to reduce the curvature of the transfer sheet 34 and separate the front end of the transfer sheet 34 from the recording material. The second sheet of recording material is separated by inserting the separation pawls 42 between the recording material P and the transfer sheet 34. In order to prevent disturbance of an image when the recording material P is separated from the transfer sheet 34, it is preferred to perform AC corona discharge using a corona discharging unit 17 as shown in FIGS. 1 and 2.

Figure 7:
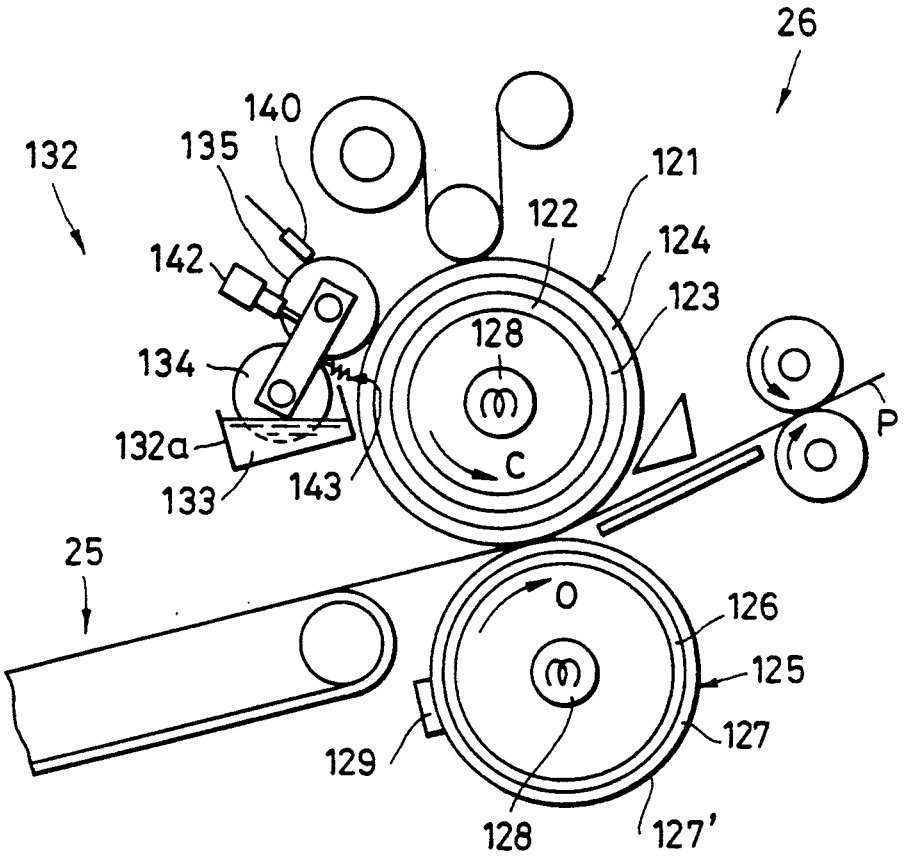
FIG. 7 is a schematic diagram of the configuration of a fixing device.

If the length of the recording material in the direction of feeding is greater than the length obtained by subtracting the width of the connecting unit 33 from the circumference of the transfer drum 30, the front end of the recording material is adhered on the transfer sheet 34 at the same position as the front end of the above-described first sheet of recording material irrespective of the copying operation of one sheet of the recording material or the continuous copying operation of a plurality of sheets of recording material, and the same transfer/separation processing as in the case of the first sheet of recording material is performed. At that time, the pressing rollers 53 for inward separation are not driven. After the completion of the transfer/separation processing, the recording material is conveyed to a fixing device 26 through a conveying belt 25. The fixing device 26 will be explained with reference to FIG. 7.

The fixing device 26 comprises a fixing roller 121 and a pressing roller 125. The two rollers 121 and 125 are rotatably driven in the directions of Arrows C and D, respectively, and are in pressure contact with each other. The fixing roller 121 comprises an HTV silicone rubber (high-temperature-vulcanized silicone rubber) 123 coated to a predetermined thickness on the outer layer of a core bar 122 made of aluminum, and an LTV silicone rubber (low-temperature-vulcanized silicone rubber) 124 200 μm thick coated on the outer layer of the HTV silicone rubber. The pressing roller 125 comprises an HTV silicone rubber 127 coated to a predetermined thickness on the outer layer of a core bar 126 made of aluminum, and a resin layer 127' coated on the surface layer of the HTV silicone rubber 127. A halogen-lamp heater 128 is disposed within each of the fixing roller 121 and the pressing roller 125. A thermistor 129 contacts the pressing roller 125, and performs the on-off control of the current supplied to the halogen-lamp heater 128. Thus, the surface temperatures of the fixing roller 121 and the pressing roller 125 are maintained at a predetermined value (for example, 170° C.) which is suitable for fixing an unfixed toner image on the recording material P.

In order to improve releasability of a toner from the fixing roller 121, a release-agent coating device 132 is provided at a predetermined portion of the fixing device 26. The release-agent coating device 132 draws a silicone oil 133 (dimethylsilicone oil KF96 300CS made by Shin-Etsu Chemical Co., Ltd.) from an oil tank 132a using a group of rollers 134 and 135, regulates the drawn silicone oil 133 to a predetermined amount by a coating-amount adjusting blade 140, and coats the silicone oil 133 on the fixing roller 121 by an on-off device comprising a plunger 142 and a spring 143.

When the recording material P passes between the fixing roller 121 and the pressing roller 125 having the above-described configuration, the toner image is fixed on the recording material P by means of the heat and pressure of these rollers.

An explanation will now be provided of a developer, that is, a toner, used in such a color electrophotographic copying apparatus.

In forming a multicolor image or a full-color image, by using a toner having a sharp-melting property, it is possible to widen a color reproduction range of a copy, and to obtain a color copy faithful to an original.

A toner is produced by fusing, mixing, pulverizing and classifying a toner forming material comprising a binding resin, such as a polyester resin or a styrene-acrylic ester resin, a coloring agent (a dye or a sublimation-type dye), a charge controlling agent and the like. If necessary, various kinds of external additives (for example, hydrophobic colloidal silica) are added to the toner.

In consideration of fixability and sharp-melting property, a color toner comprising a polyester resin as a binding resin is preferred. As an example of a sharp-melting polyester resin, there is a high molecular compound having ester bonds in principal chains of a molecule synthesized from a diol compound and dicarboxylic acid.

Particularly, a polyester resin obtained by at least copolymerizing a bisphenol derivative or its substitution product represented by the following formula:

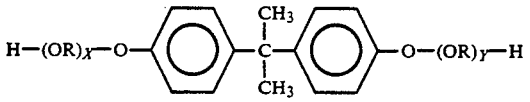

Figure 8:
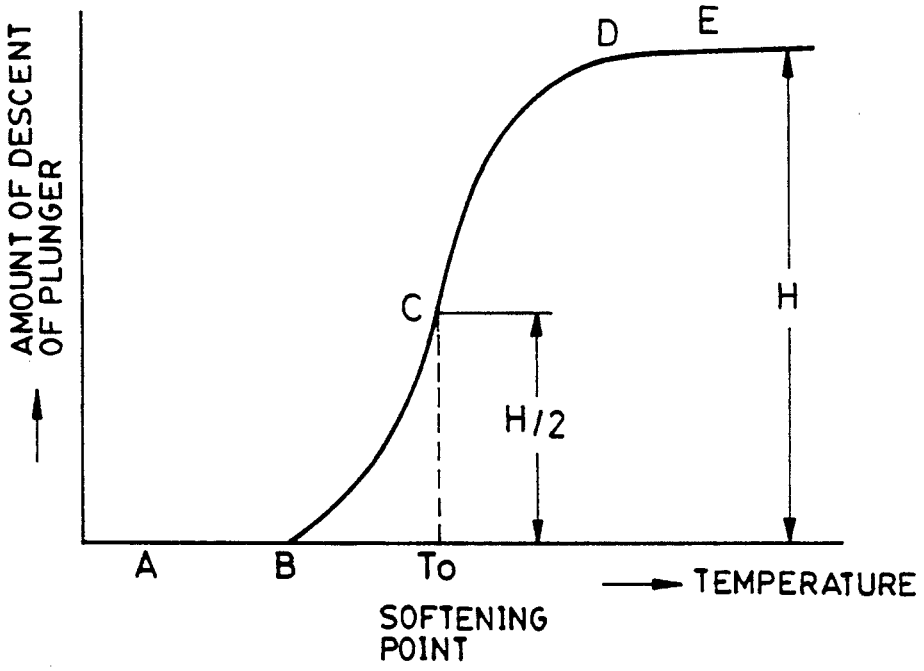
FIG. 8 is a graph showing a softening characteristic of a toner.

(in the formula, R represents an ethylene or propylene radical, X and Y represent positive integers equal to at least 1, and the average value of X+Y is 2–10) as a diol component, and carboxylic acid whose valency is at least two, its acid anhydride, or carboxylic acid obtained by low alkyl esterification of the above-described carboxylic acid (for example, fumaric acid, maleic acid, maleic anhydride, phthalic acid, terephthalic acid, trimellitic acid, pyromellitic acid or the like) as dicarboxylic acid is preferred because of having a sharp melting property. The softening point of the polyester resin may be 75°–150° C., preferably 80°–120° C. FIG. 8 shows a softening characteristic of a toner including such a polyester resin as a binding resin.

The method of measuring the softening point will now be explained. A flow tester of type CFT-500A (made by Shimadzu Corporation) is used. A pushing load of 20 kg is applied through a die (nozzle) 1.0 mm thick and having a diameter of 0.2 mm. The curve of the amount of descent of a plunger vs temperature (the softening S-like curve) of a toner depicted when the toner is heated at a constant speed of 6° C./min. after an initial setting temperature of 70° C. and a preheating time of 300 seconds is obtained. Toner fine particles which are precisely weighed to be 1–3 g are used as the sample. The cross section of the plunger is 1.0 $cm^2$. The softening S-like curve becomes as shown in FIG. 8. As temperature is increased at the constant speed, the toner is gradually heated and the outflow of the toner starts (portion A-B where the plunger descends). As temperature is further increased, the toner in a fused state greatly flows out (portion B-C-D). Finally, the plunger stops to descend, and the test is ended (portion D-E).

The height H of the S-like curve indicates the total flow amount, and the temperature $T_0$ corresponding to point C having a height of H/2 indicates the softening point of the sample (for example, a toner or a resin).

It is possible to determine whether or not a toner or a binding resin has a sharp melting property by measuring the apparent melt viscosity of the toner or the binding resin.

A toner or a binding resin having a sharp melting property is defined to satisfy the conditions of:

$$T_1 = 90° - 150° \text{ C.}$$

$$|\Delta T| = T_1 - T_2| = 5° - 20° \text{ C.},$$

where $T_1$ represents a temperature when the apparent melt viscosity has a value of $5 \times 10^3$ poises, and $T_2$ represents a temperature when the apparent viscosity has a value of $5 \times 10^2$ poises.

A sharp melting resin having the above-described temperature-melt viscosity characteristics has a feature in that its viscosity very sharply decreases by being heated. Such a decrease in viscosity causes appropriate mixture of the uppermost toner layer and the lowermost toner layer, and abruptly increases the transparency of the toner layer itself, making possible an excellent subtractive color mixture.

Next, the operation of the two sheets of the recording materials P simultaneously carried at different positions on the transfer drum 30 after the transfer operation will be explained in detail.

In the present embodiment, after toner images of respective colors have been transferred onto the two sheets of recording material P carried on the transfer drum 30, the two sheets of recording material P are separated from the transfer drum 30. Between the two sheets of recording material continuously separated during one revolution of the transfer drum 30, the first sheet to be separated is conveyed from the conveying belt 25B (see FIG. 1) at the upstream side in the moving direction of the recording material onto the conveying belt 25A at the downstream side in the moving direction of the recording material, and the second sheet to be separated is placed on the conveying belt 25B at the upstream side.

In the present embodiment, if the apparatus is in a normal operation mode, and the recording material P is ordinary paper having a weight of 50–90 g/$m^2$, the moving speed of the transfer drum 30 and the conveying belts 25A and 25B, and the fixing speed have a value of 84 mm/sec, which is the same as the process speed. Accordingly, the interval between the above-described continuous two sheets of the recording material is almost the same when the recording material P is carried on the transfer drum 30, and when the recording material P enters the fixing device.

If the apparatus is in a special operation mode, and the recording material comprises thick paper having a weight of 90–150 g/mm$^2$ or a resin-like film for which a fixing operation must be performed at a speed lower (a fixing speed of 25 mm/sec) than in a normal case (a fixing speed of 84 mm/sec), the first separated sheet is placed on the conveying belt 25A at the downstream side, and the second separated sheet is placed on the conveying belt 25B at the upstream side. At that time, the conveying belt 25B at the upstream side is stopped, and only the conveying belt 25A at the downstream side is operated. As a result, only the first separated sheet is fixed by the fixing device 26 at a fixing speed of 25 mm/sec, which is lower than the normal speed. After this sheet has been discharged, the conveying belt 25B at the upstream side is operated to convey the second sheet of recording material to the conveying belt 25A at the downstream side. The sheet is further conveyed to the fixing device, fixed at a speed lower than the normal speed, and discharged. That is, the interval between when the two continuous sheets of recording material enter the fixing device is longer than when the sheets are carried on the transfer drum 30. Accordingly, the interval between times to enter the fixing device for the two continuous sheets of the recording material is set to be greater when the fixing speed is slower than in the normal case.

According to the above-described configuration, the second sheet of recording material is prevented from interfering with the first sheet in the fixing device and causing disturbance of an image, paper jamming and the like, and an excellent image may be formed.

The present invention does not always necessitate the above-described two conveying belts 25A and 25B, but, as shown in FIG. 2, the present invention may also be applied to an image forming apparatus including only one conveying belt 25. When the apparatus is in a normal operation mode, and the recording material is ordinary paper, the same operation as in the foregoing embodiment may be performed. Hence, only the case of a special operation mode wherein thick paper or a resin-like film is used as the recording paper will now be explained.

In the present embodiment, when a continuous copying operation of a plurality of sheets is set, sheets of the recording material are continuously fed, two sheets of the recording material P are simultaneously adhered at different positions on the transfer drum 30, and toners of respective colors are transferred onto the sheets of the recording material. When the sheets are subsequently separated, the two sheets of the recording material P on the transfer drum 30 are not continuously separated. First, only the first sheet of the recording material is separated from the transfer drum 30 by the separation means 40. After the separation of the first sheet, the second sheet of the recording material is left on the transfer drum 30 without being separated, and performs at least one revolution with the transfer drum 30.

That is, the sheet of the recording material P whose front end is closer to the connecting unit 33 on the transfer drum 30 is separated first, and the remaining, or second, sheet of the recording material P continues to rotate on the transfer drum 30.

The first sheet of recording material which has been separated is conveyed to the fixing device 26 via the conveying belt 25, and fixed at a low speed (25 mm/sec).

After the fixing operation of the first sheet of recording material has been completed, that is, after the sheet has been discharged from a nip portion of the pair of rollers of the fixing device, the second sheet of recording material is separated from the transfer drum 30, conveyed to the fixing device 26 via the conveying belt 25 at substantially the same conveying speed as the conveying speed of the first sheet, and fixed at a low speed (25 mm/sec).

According to the above-described configuration, the second sheet of recording material will not interfere with the first sheet in the fixing device to cause disturbance of an image, paper jamming and the like, and an excellent image may be formed. Furthermore, according to the present embodiment, the recording-material conveying path at the downstream side of the transfer drum has a configuration which is simpler than in the FIG. 1 embodiment, providing a smaller apparatus.

Although, in the above-described embodiment, the sheet of recording material to be separated first is assumed to be the first sheet whose front end is closer to the connecting unit 33, the sheet succeeding the first sheet, that is, the second sheet of the recording material, may be separated first. However, from the viewpoint of continuity of the image forming operation, it is preferred to first separate the sheet of the recording material closer to the connecting unit 33.

In the above-described embodiment, after separating the first sheet of recording material, the other sheet of the recording material left on the transfer drum 30 continues to rotate on the transfer drum 30. At that time, it is preferred that the corona charger 14 for transfer is more or less operated (charging operation) because of the following reason. That is, toner images of a plurality of layers are formed on the second sheet of the recording material adhered and held on the transfer drum 30. The above-described operation is performed in order to prevent that, while the toner images are rotated on the transfer drum 30 as described above, the toner images are disturbed due to contact with the photosensitive drum 6, or the sheet is peeled from the transfer drum 30.

In the present embodiment, as for the timing to separate the second sheet of the recording material from the transfer drum 30, the following methods may be suitably used.

(a) After the first sheet of the recording material has been fixed at a low speed (25 mm/sec) and the fixing operation has been completely terminated, the second sheet of the recording material is separated from the transfer drum 30.

(b)While the first sheet of the recording material is fixed at a low speed (25 mm/sec), the second sheet of the recording material is separated from the transfer drum 30. Any timing with which the second sheet of the recording material enters the fixing device may be adoped, provided that the fixing operation of the first sheet of the recording material has been completed.

In the present invention, whether the recording material is thick paper or a resin-like film may be indicated from an operation panel. Alternatively, the detection may be automatically performed using a photosensor, a distance sensor (not shown) or the like on the conveying path between the registration rollers 28 and the conductive roller 24, or the like.

When the image forming apparatus of the present invention is not an image forming apparatus, such as a copier or the like, which performs various kinds of indications from an operation panel, as in the present embodiment, but is an apparatus, such as a printer, which is operated by a computer, the apparatus may determine that the recording material is thick paper or a resin-like film according to an indication from the computer.

In the foregoing respective embodiments, methods wherein the recording material is adhered on the transfer drum 30 using an adhesive force due to electric charges have been explained. Another method, wherein two connecting units 33 are provided in the transfer drum 30, and grippers or air-sucking holes for holding the recording material are provided in the connecting units 33 to hold two sheets of the recording material on the transfer drum 30, may also be effectively used for an image forming apparatus of the present invention.

In the foregoing embodiments, a transfer belt may be used in place of the transfer drum, serving as a recording material carrying means.

At least three sheets of the recording material may, of course, be simultaneously carried on the recording material carrying means.

Although the above-described embodiments use a method in which the toner image formed on the photosensitive drum is transferred on the recording material, the present invention may also be applied to a method which does not require transfer, such as an ink-jet method, in which a recording head as image forming means faces an endless belt as recording material carrying means and recording is performed on a recording material, such as paper or the like, electrostatically adhered on the belt by the recording head.

As explained above, according to the image forming apparatus of the present invention, by changing the interval between times to enter the fixing means for the first sheet of recording material and the second sheet of the recording material carried on the recording material carrying means in accordance with the fixing speed, the second sheet will not catch-up and interfere with the first sheet to disturb the formed images, or cause paper jamming or the like. Hence, the present invention is capable of consistently obtaining a permanent image having an excellent picture quality.

In the image forming apparatus of the present invention, in continuously forming an image on a plurality of sheets, the image may be formed faster than in an image forming apparatus which repeats a sequence of performing transfer and fixing processing while individually feeding each sheet of a recording material.

What is claimed is:

1. An image forming apparatus, comprising:

recording material carrying means for carrying and conveying a recording material;

image forming means for forming an image on the recording material carried on said recording material carrying means;

separating means for separating the recording material from said recording material carrying means after an image is formed; and fixing means for fixing the image on the recording material after it is separated from said recording material carrying means, with said fixing means having a variable fixing speed, wherein a first mode having a relative high fixing speed and a second mode having a relative low fixing speed are selectable in accordance with the type of recording material, said recording material carrying means being capable of simultaneously carrying first and second sheets of the recording material at different positions thereon independently of the selection of the first mode or the second mode, and wherein the period after an image is formed on the second sheet by said image forming means until the second sheet enters said fixing means is longer in the second mode than in the first mode.

2. An image forming apparatus according to claim 1, further comprising conveying means for conveying to said fixing means the recording material separated from said recording material carrying means.

3. An image forming apparatus according to claim 1, wherein when the second mode is selected, the second sheet of recording material is separated from said recording material carrying means after a fixing operation of the first sheet of recording material is completed by said fixing means.

4. An image forming apparatus according to claim 2, wherein when the second mode is selected, the second sheet of recording material is stopped on said conveying means so that the second sheet enters said fixing means after completion of a fixing operation of the first sheet.

5. An image forming apparatus according to claim 1, wherein said first mode is selected when the recording material is plain paper and said second mode is selected when said recording material is resin-like film or paper thicker than the plain paper.

6. An image forming apparatus according to claim 2, wherein when the second mode is selected, conveying speeds of the first and second sheets of the recording material by said conveying means are substantially the same.

7. An image forming apparatus according to claim 1, wherein said recording material carrying means comprises a carrying surface having a dielectric sheet for carrying the recording material, and said recording material carrying means is endlessly movable.

8. An image forming apparatus according to claim 7, further comprising adhesion means for electrostatically adhering the recording material on said carrying surface.

9. An image forming apparatus according to claim 1, wherein said image forming means comprises an image bearing member, toner image forming means for forming a toner image on said image bearing member, and transfer means for transferring the toner image on said image bearing member to the recording material.

10. An image forming apparatus according to claim 9, wherein toner images of a plurality of colors on said image bearing member are superposed on the recording material by said transfer means.

11. An image forming apparatus according to claim 10, wherein the toner images of the plurality of colors superposed on the recording material are subjected to color mixture to form a full-color toner image.

12. An image forming apparatus according to claim 3, wherein said recording material carrying means is rotatable, and, when the second mode is selected, said recording material carrying means performes at least one revolution while carrying the second sheet of recording material after the first sheet of recording material is separated from said recording material carrying means by said separating means.

13. An image forming apparatus according to claim 9, wherein in said first and second mode, moving speeds of said image bearing member and said carrying means are fixed.

14. An image forming apparatus according to claim 1, wherein after forming of the image on said recording material in said second mode, an interval between the first sheet and the second sheet is made smaller.

15. An image forming apparatus according to claim 1, wherein in carrying the first sheet and the second sheet by said recording material carrying means, an interval between the first sheet and the second sheet is the same in the first mode and in the second mode.

16. An image forming apparatus according to claim 1, wherein the period after an image is formed on the recording material by said image forming means until the recording material enters said fixing means is longer in case of the second sheet than in case of the first sheet.

* * * * *

UNITED STATES PATENT AND TRADEMARK OFFICE

CERTIFICATE OF CORRECTION

PATENT NO. : 5,249,024

DATED : September 28, 1993

INVENTOR(S) : TAKESHI MENJO

It is certified that error appears in the above-indentified patent and that said Letters Patent is hereby corrected as shown below:

Column 1,
Line 59 "apts" should read --is apt--.

Column 4,
Line 34, "butting" should read --Butting--; and
Line 55, "is" should read --in--.

Column 5,
Line 10, "asigned" should read --assigned--;
Line 14, "tranfer" should read --transfer--;
Line 33, "formed again on the photosensitive" should be deleted;
Line 34, "drum 6, the image is" should be deleted; and
Line 56, "tranfer" should read --transfer--.

UNITED STATES PATENT AND TRADEMARK OFFICE

CERTIFICATE OF CORRECTION

PATENT NO. : 5,249,024

DATED : September 28, 1993

INVENTOR(S) : TAKESHI MENJO

It is certified that error appears in the above-indentified patent and that said Letters Patent is hereby corrected as shown below:

Column 6,
Line 2, "notchs 37" should read --notches 37--; and
Line 7, "tranfer" should read --transfer--.

Column 10,
Line 53, "adoped," should read --adopted,--.

Column 12,
Line 56, "performes" should read --performs--.

Signed and Sealed this

Twenty-ninth Day of November, 1994

Bruce Lehman

*Attest:*

BRUCE LEHMAN

*Attesting Officer*

*Commissioner of Patents and Trademarks*